United States Patent [19]

Smal

[11] 4,293,760

[45] Oct. 6, 1981

[54] APPARATUS FOR ELECTRICALLY HEATING HAIR CURLERS

[75] Inventor: Henri Smal, Oupeye, Belgium

[73] Assignee: Societe Anonyme FACO, Herstal, Belgium

[21] Appl. No.: 929,532

[22] Filed: Jul. 31, 1978

[30] Foreign Application Priority Data

Apr. 7, 1978 [LU] Luxembourg ..... 79402

[51] Int. Cl.[3] ..... A45D 4/12; H05B 1/00

[52] U.S. Cl. ..... 219/222; 34/104; 34/243 R; 132/9; 132/33 R; 132/33 F; 219/214; 219/242; 219/368; 219/373; 219/521; 221/150 A; 312/31; 312/236

[58] Field of Search ..... 219/222–226, 219/214, 521, 368, 369, 370, 373; 34/96–101, 104–106, 243 R; 312/31, 236; 221/150 R, 150 H, 150 HC; 132/7, 9, 33 R, 33 F, 33 G

[56] References Cited

U.S. PATENT DOCUMENTS

| | | | |
|---|---|---|---|
| 3,365,811 | 1/1968 | Djenner | 34/104 X |
| 3,375,057 | 3/1968 | Morris | 312/31 X |
| 3,430,635 | 3/1969 | Kemp et al. | 219/242 X |
| 3,454,318 | 7/1969 | Kemp et al. | 221/150 HC |
| 3,483,876 | 12/1969 | Planel | 132/33 R |
| 3,513,564 | 5/1970 | Gramprie | 34/104 |
| 3,527,237 | 9/1970 | Abe | 219/222 X |
| 3,735,091 | 5/1973 | Baker | 219/222 X |

FOREIGN PATENT DOCUMENTS

| | | | |
|---|---|---|---|
| 2058788 | 5/1972 | Fed. Rep. of Germany | 219/222 |
| 17018 | of 1914 | United Kingdom | 219/370 |
| 1185689 | 3/1970 | United Kingdom | 219/222 |

*Primary Examiner*—A. Bartis

*Attorney, Agent, or Firm*—Martin A. Farber

[57] ABSTRACT

An apparatus and uniformly heating a plurality of hair curlers by passing a current of hot air longitudinally through the hair curler body includes a hollow case having an upper wall forming a support surface in which is formed a central air inlet opening into which the hot air discharge nozzle of a portable electric air heating device is inserted. A plurality of hot air discharge ports are radially centered around the inlet opening and each port is provided with a holding member for supporting a hair curler in the path of hot air discharged from the port. The curler body is provided with an inner element able to accumulate and conserve heat. When the curlers are mounted at the ports on the holding members, hot air blown into the case will pass into the curlers and heat them. Each curler may include a cover for receiving hot air from within the curler and deflecting the hot air to flow in the reverse direction along the outer wall of the curler.

10 Claims, 5 Drawing Figures

HOT AIR GENERATOR
1
1'
2
2'
2"
3
3'
4
5
6
7
8
8A
9
10
11
12
13
14
19

APPARATUS FOR ELECTRICALLY HEATING HAIR CURLERS

The present invention relates to a method of heating hair curlers enabling this to be done in a simple and inexpensive manner. The invention also relates to an apparatus for realizing said method.

Although it is known to heat substantially bobbin-shaped hair curlers by connecting them to electrical resistance heating elements, it is advantageous according to the present invention to provide for the heating thereof by hot air. The method according to the invention comprises passing a hot air flow through the axis of the hair curler body, which is provided with an internal element able to accumulate and retain heat.

According to the invention the apparatus which realizes the above method comprises a hair curler support having a series of hot air discharge ports, each of these ports being provided with a retaining member for a hair curler and the support is supplied with a hot air generator equipped with a fan.

A further object of the present invention comprises the hair curler to be used with such an apparatus. For the recovery and a a better efficiency of the hot air flow passing through the hair curler, the latter can be provided with a cover having directional passageways for directing the hot air flow from the top towards the outside along the hair curler wall.

Yet a further object of the present invention is to provide an apparatus for performing the method and which is able to operate continuously, which is particularly intended for professional use.

Such an apparatus comprises a hair curler support in the form of a case, whose upper wall carries a series of air discharge ports supplied by a hot air generator fitted in said case in order to form a single apparatus and is characterized in that the upper wall of this case is shaped in such a way as to form inclined supporting members for a series of hair curlers disposed in each series so as to form an axial extension of one another, and the base of the supporting base formed with the ports.

Figures 1, 2, 3:
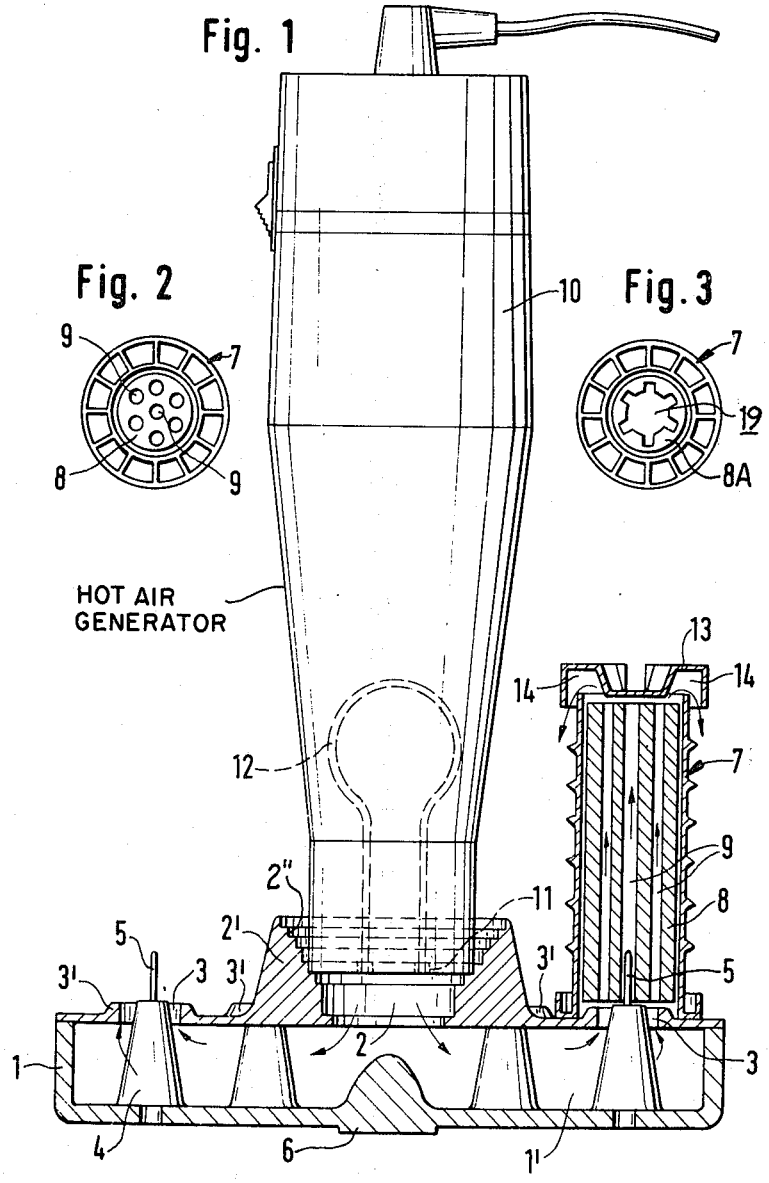
Figure 4:
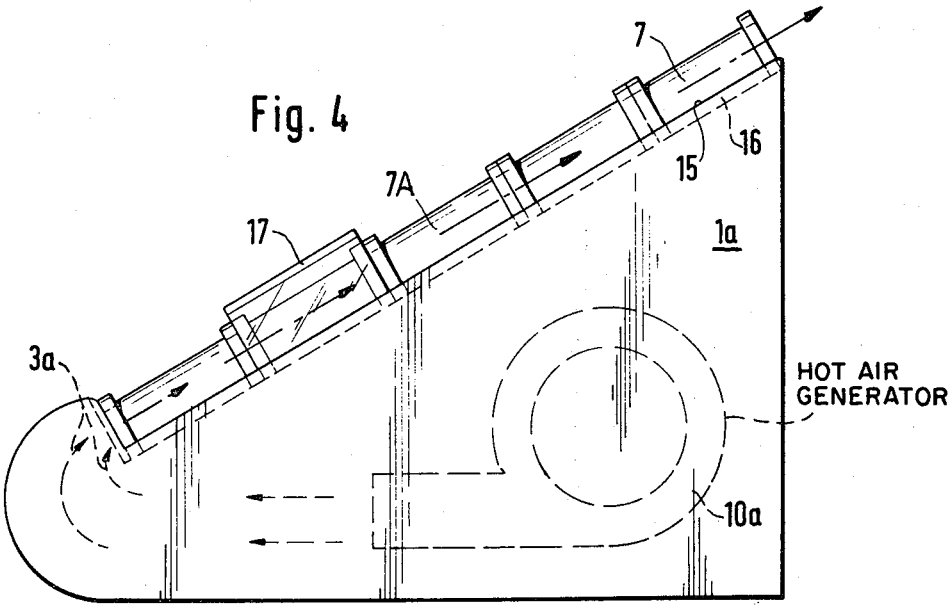
Figure 5:
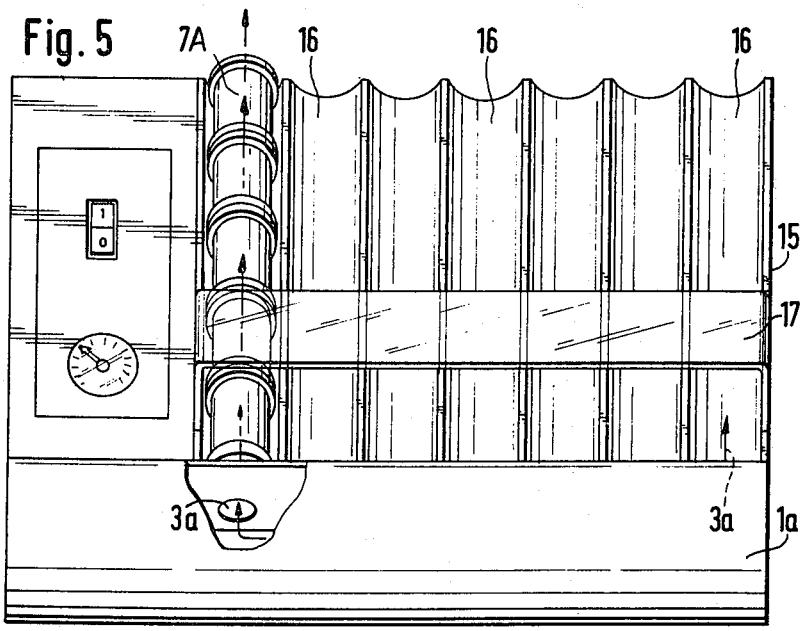

The invention will be described in greater detail hereinafter relative to non-limitative embodiments and with reference to the attached drawings, wherein:

FIG. 1 is a view partially in section of one embodiment of an apparatus for heating hair curlers according to the invention, particularly intended for private use, FIGS. 2 and 3 are views of two embodiments of hair curlers to be heated in accordance with the invention, FIG. 2 being a view of the bottom of the hair curler shown in FIG. 1 and FIG. 3 being a similar view of another hair curler, FIG. 4 is a side view of an apparatus for professional use, and FIG. 5 is a front view of the apparatus of FIG. 4.

FIGS. 1–3 of the drawings show an apparatus for heating hair curlers in accordance with the present invention and adapted with a hair dryer which in this case constitutes the heating body.

As can be gathered from the drawings the hair curler support is constituted by a case 1, whose upper wall has in its center a projection 2′ through which there is formed an opening 2, while around said latter opening there are formed a series of hot air discharge ports 3.

Ports 3 and opening 2 open into chamber 1′ which is formed in the case 1 and therefore communicate with one another. Each of the ports 3 contains a frustum-shaped holding member 4 forming a constriction with each of the members 4 being supported on the bottom wall of the case 1 and carrying in its center a pin 5 which projects outside the case.

The bottom wall of case 1 may advantageously be duplicated and provided with a (not shown) insulation, whereby the case carries externally in its center a small shoulder 6 which serves to rest on a support such as a table and to permit the case to rotate about its axis.

To each pin 5 there is connected a hair curler 7 in the form of a cylinder with projections. The body of the hair curler 7 has an inner axial element 8 which accumulates and retains heat. Element 8 may comprise various suitable materials, such as for example metal, refractory, thermoplastic or thermosetting materials.

FIG. 2 shows a hair curler, whose inner element 8 is made from a refractory material and is provided with a series of longitudinal passages 9, the central passages serving for fixing to pin 5. In FIG. 3 the hair curler has an aluminum inner element 8 in the form of a tube with internal vanes, the opening 19 of which is applied to the rim 3′ of the air port 3. Obviously the internal element can be constructed conforming to the method of fitting the hair curler to the case, which may be effected by means of pins, clips, a magnet, etc.

The mouthpiece of a fan heating body, such as hair dryer 10 is fitted into opening 2. One type of hair dryer is shown, but various other types of hair dryers may also be used. However, as they often have different diameters, the projection 2′ through which the opening 2 extends has an interior wall with circular steps 2″, whose diameter decreases towards the bottom. As a result it is possible to insert in the opening 2 a large variety of hair dryer mouthpieces, whereby the end thereof rests on one or other of the steps. As the retaining surface, i.e., the distance between two steps is not very large, two or more holding pins, such as 12 are inserted in the holes 11 of the upper step.

Certain steps may advantageously be provided with (not shown) bosses so as to permit the escape of surplus air in the case of very powerful apparatus.

In order to recover the heat leaving the top of the heat accumulating elements 8, the hair curlers are provided with a cover 13 having directional passageways 14 for receiving and then directing the hot air externally along the hair curler wall.

Thus in the case when the hair dryer is connected to an electrical power supply, heating of the hair curlers can commence. It is merely necessary to start the hair dryer 10, which passes hot air through opening 2 into chamber 1′ and from the latter the hot air is distributed through ports 3 into hair curler 7 and more specifically into the heat accumulating elements 8.

The constriction provided in ports 3 by members 4 prevents too easy an escape of air and ensures that the correct temperature is reached. This constriction is shaped in such a way that it creates more of an obstacle to the passage of air than the actual hair curler in such a way that the same air outlet is obtained whether the hair curler is mounted on its support or not.

The heating body or hot air generator can be mounted to the support at various places, but if it is located in the center of the support, as in the present embodiment, a good air balance and a back draught through the top of the body are obtained.

The apparatus with the use of a hair dryer is of particular interest, because it can form part of a hair brushing set comprising a hair dryer, brushes, etc., but instead of a case to which there is applied an independent heating body, the apparatus for realizing the invention may comprise a case which has within it the fan heating body in such a way that a single apparatus is formed, which can have any appropriate shape.

For professional use a large number of hair curlers have to be heated, so that an apparatus has been constructed (FIGS. 4 and 5) in which case 1*a* contains a hot air generator 10*a* and is in the form of a console, whose upper inclined wall 15 is formed by a series of channels 16 into the base of each of which there communicates a hot air port 3*a* supplied by the hot air generator 10*a*.

A series of hair curlers 7A is aligned with each channel 16 in such a way that the heat accumulating elements of the hair curlers in the series communicate with the corresponding port 3*a*. In this case it is obvious that hair curlers with a cover of the type described hereinbefore will not be used, so that the hot air flow can pass from one hair curler to the next in series.

As the hair curlers heat to a greater extent the closer they are to the bottom of the channel, the curlers in the lower row are always used. On removing the bottom hair curler in a series, the complete series will slide in the channel due to the inclination of the supporting wall 15 of the case and the removed bottom curler will be automatically replaced. In order that the complete row of hair curlers is not removed from the channel during the removal of the lower curler a stop plate 17 is placed transversely over the immediately preceding row.

In such an apparatus the hot hair curlers are taken from the bottom and the cold hair curlers are inserted at the top. Such an apparatus makes continuous working possible.

Support 1*a* has been provided in the form of a console, but obviously the apparatus could comprise a case with a vertical curler supporting wall or could be in the form of a drum with vertical or inclined curler carrying channels.

I claim:

1. Apparatus, comprising a hair curler support having a hollow interior and a support surface formed with a central hot air inlet opening and a plurality of hot air discharge ports arranged radially about in spaced relationship from and centered around said inlet opening, said opening and said discharge ports communicating with the interior of said support, means for holding a hair curler on said support surface at each of said ports in the path of air discharged from the port, a hot air generating means for supplying hot air into said support through said opening for discharge from each of said ports.

2. Apparatus according to claim 1, wherein said hot air generating means comprises a portable forced circulation air heating device having a hot air discharge nozzle, said hair curler support is in the form of a hollow case having an upper wall which forms said support surface and in which is formed said plurality of hot air discharge ports and said support includes an opening means forming said inlet opening and into which is inserted the discharge nozzles of said portable forced circulation air heating device.

3. Apparatus according to claim 2, characterized in that the opening means includes an interior wall with steps adapted for the selective reception of different diameter air discharge nozzles.

4. Apparatus according to claim 3, wherein the case includes pins inserted into holes formed in the steps of the opening means, said pins constituting means for holding the forced circulation air heating device in position on the case.

5. Apparatus according to claim 2, wherein the opening means into the case is located in the center of the upper wall of the case, and said air discharge ports with said holding means are distributed around said opening means.

6. Apparatus according to claim 5, wherein said case is round and the bottom wall thereof includes means for permitting the case to rotate about a central axis.

7. Apparatus according to claim 1, wherein said holding means is disposed in the hot air discharge ports and form therewith a constriction means for bringing about a greater slowing down of the air flow than that caused by said hair curler when mounted at said ports.

8. Apparatus as set forth in claim 7, wherein said holding means are frustoconical members narrowing into said ports.

9. The apparatus as set forth in claim 1, wherein said support is formed with a rounded projection opposite to and facing toward said central inlet opening and constituting means for directing the hot air entering from said inlet opening of said support radially outwardly toward said hot air discharge ports.

10. A hair curling apparatus comprising a plurality of hollow bobbin-shaped hair curlers, support means for supporting the hair curlers, said support means being formed with a central inlet opening constituting means for entrance of hot air as well as a series of ports constituting means for the discharge of the hot air, said ports being arranged radially about in spaced relationship from and centered around said inlet opening, said ports being adapted to be fed by a hot air generator communicating with said inlet opening and being adapted to communicate with an inner part of the hair curlers, said support means being formed as a hollow case having an upper wall upon which said curlers are supported and in which said ports are formed, said hair curlers being mountable on said support means in communication with said ports and each containing an axial element made of a material means for accumulating and retaining heat, and said material means being formed with at least one longitudinal passage open at two extremities of the hair curler and communicating with said port.

* * * * *